US012345000B2

(12) United States Patent
Weiser et al.

(10) Patent No.: US 12,345,000 B2
(45) Date of Patent: Jul. 1, 2025

(54) ROAD FINISHING MACHINE AND METHOD FOR LEVELLING A SCREED

(71) Applicant: JOSEPH VOEGELE AG, Ludwigshafen/Rhein (DE)

(72) Inventors: Ralf Weiser, Ladenburg (DE); Philipp Stumpf, Heidelberg (DE); Stefan Simon, Neuhofen (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 918 days.

(21) Appl. No.: 17/497,086

(22) Filed: Oct. 8, 2021

(65) Prior Publication Data

US 2022/0112669 A1 Apr. 14, 2022

(30) Foreign Application Priority Data

Oct. 8, 2020 (EP) ..... 20200791

(51) Int. Cl.
*E01C 19/48* (2006.01)
*E01C 19/00* (2006.01)
*E01C 23/01* (2006.01)

(52) U.S. Cl.
CPC ..... *E01C 19/4873* (2013.01); *E01C 19/006* (2013.01); *E01C 23/01* (2013.01)

(58) Field of Classification Search
CPC ..... E01C 19/4873; E01C 19/006; E01C 23/01
See application file for complete search history.

(56) References Cited

U.S. PATENT DOCUMENTS 4,807,131 A 2/1989 Clegg
5,393,167 A * 2/1995 Fujita ..... E01C 19/006 404/84.1

(Continued)

FOREIGN PATENT DOCUMENTS

CN 101248235 A 8/2008
CN 101368361 A 2/2009

(Continued)

OTHER PUBLICATIONS

First Office Action and Search Report for Chinese Patent Application No. 202111158048.1, dated Jan. 19, 2023, 5 Pages.

(Continued)

*Primary Examiner* — Abigail A Risic
(74) *Attorney, Agent, or Firm* — BROOKS KUSHMAN P.C.

(57) ABSTRACT

A road finishing machine comprises a screed for producing a paving layer on a subsoil on which the road finishing machine is movable in a laying direction, wherein the screed has a pulling arm fixed to the road finishing machine at a front pulling point by a levelling cylinder; at least one measuring means for performing a distance measurement, a storage means, and a controlling system. The controlling system is embodied to calculate a correction value in response to at least one distance measurement performed with respect to the subsoil and/or to a reference, which is performable at a measuring point in front of a front edge of the screed, to at least temporarily store the correction value in the storage means and calculate a desired levelling value for the measuring point taking into consideration the stored correction value, based on which the levelling cylinder of the screed is controllable.

17 Claims, 5 Drawing Sheets

(56) References Cited

U.S. PATENT DOCUMENTS

| | | | | |
|---|---|---|---|---|
| 5,568,992 | A | 10/1996 | Grembowicz et al. | |
| 6,027,282 | A * | 2/2000 | Horn | G01C 15/004 404/75 |
| 7,643,923 | B2 | 1/2010 | Buehlmann et al. | |
| 8,070,385 | B2 | 12/2011 | Green | |
| 8,079,776 | B2 | 12/2011 | Lossow | |
| 8,371,769 | B2 * | 2/2013 | Worsley | E01C 19/48 404/84.2 |
| 8,696,237 | B2 | 4/2014 | Hanfland et al. | |
| 9,033,611 | B2 * | 5/2015 | Hanfland | G01B 21/18 404/84.1 |
| 9,458,581 | B1 | 10/2016 | Schaeding | |
| 9,534,349 | B2 * | 1/2017 | Horn | E01C 19/42 |
| 11,560,675 | B2 * | 1/2023 | Buschmann | E01C 19/185 |
| 2011/0126533 | A1 | 6/2011 | Noll et al. | |
| 2011/0255918 | A1 * | 10/2011 | Worsley | E01C 19/48 404/84.1 |
| 2012/0321386 | A1 | 12/2012 | Hanfland et al. | |
| 2013/0253780 | A1 | 9/2013 | Smieja et al. | |
| 2017/0044726 | A1 | 2/2017 | Buschmann et al. | |
| 2018/0340302 | A1 | 11/2018 | Menzenbach et al. | |
| 2019/0177930 | A1 | 6/2019 | Ramb et al. | |
| 2021/0010210 | A1 | 1/2021 | Ellwein et al. | |
| 2022/0112669 | A1 * | 4/2022 | Weiser | E01C 23/01 |
| 2022/0290382 | A1 | 9/2022 | Simon et al. | |

FOREIGN PATENT DOCUMENTS

| | | | |
|---|---|---|---|
| CN | 102174792 | A | 9/2011 |
| CN | 102220738 | A | 10/2011 |
| CN | 102839592 | A | 12/2012 |
| CN | 106522065 | A | 3/2017 |
| CN | 107741719 | A | 2/2018 |
| CN | 109914203 | A | 6/2019 |
| CN | 111601929 | A | 8/2020 |
| CN | 111945524 | A | 11/2020 |
| DE | 29619831 | U1 | 1/1997 |
| DE | 69126017 | T2 | 11/1997 |
| DE | 19647150 | A1 | 5/1998 |
| DE | 10025462 | A1 | 12/2001 |
| DE | 10025474 | A1 | 12/2001 |
| DE | 102005022266 | A1 | 11/2006 |
| DE | 10025474 | B4 | 3/2011 |
| DE | 112009001767 | T5 | 9/2011 |
| DE | 102011001542 | A1 | 12/2012 |
| DE | 102015001101 | A1 | 8/2016 |
| EP | 1672122 | A1 | 6/2006 |
| EP | 2535456 | A1 | 12/2012 |
| EP | 3178992 | A1 | 6/2017 |
| IN | 202014019027 | A | 11/2020 |
| JP | H04179710 | A | 6/1992 |

OTHER PUBLICATIONS

European Search Report Dated Apr. 8, 2021 (with English Machine Translation), Application No. 20200791.0-1002, Applicant Joseph Voegele AG, 20 Pages.

European Search Report Dated Sep. 7, 2021 (with English Machine Translation), Application No. 21162228.7-1002, Applicant Joseph Voegele AG, 10 Pages.

U.S. Appl. No. 17/691,602, filed Mar. 10, 2022, 25 Pages.

Pu Xinzheng, Exploring the Application of Ultrasonic Sensors in the Automatic Leveling Control system of Paver, China New News 07th period, Apr. 5, 2017, 85, School of Mechanical and Electrical Engineering, Jiangsu Vocational and Technical College of Architecture.

CNIPA First Office Action in CN Application No. 202210249699X dated Mar. 15, 2024 (5 pages, including English translation).

Chinese Search Report for CN Application No. 202210249699X, dated Mar. 13, 2024, 10 pages.

JPO Office Action in JP Application No. 2021-165520 dated Mar. 7, 2025 (4 pages, including English translation).

USPTO Office Action in U.S. Appl. No. 17/691,602 dated Mar. 13, 2025 (24 pages).

* cited by examiner

ROAD FINISHING MACHINE AND METHOD FOR LEVELLING A SCREED

CROSS-REFERENCE TO RELATED APPLICATIONS

This application claims foreign priority benefits under 35 U.S.C. § 119(a)-(d) to European patent application number EP 20200791.0, filed Oct. 8, 2020, which is incorporated by reference in its entirety.

TECHNICAL FIELD

The present disclosure relates to a road finishing machine and a method for levelling a screed of a road finishing machine.

BACKGROUND

In DE 196 47 150 A1, DE 296 19 831 U1, and DE 100 25 474 B4, levelling systems for a screed of a road finishing machine are disclosed. These levelling systems have a pulling point control loop which functions taking into consideration a difference of a pulling arm inclination detected with an inclination sensor and a desired inclination value for the pulling arm. The desired inclination value is calculated based on height monitoring performed in the region of a screed's rear edge. In the height monitoring, distance measurements to a reference in the region of the screed's rear edge are performed and compared to a desired distance to determine the desired inclination value. In this device, irregularities of the subsoil present in front of the screed can only be taken into consideration inaccurately or not at all in the levelling process.

In the practice described above, in particular the use of inclination sensors turned out to be problematic since these may react sensitively to irregularities of the subsoil and vibrations during the laying operation which may have a negative influence on a levelling regulation based thereon. Moreover, for the above-described pulling point control loop, great open-loop and closed-loop control efforts are made due to the fact that pulling point control takes place simultaneously with the height monitoring.

DE 100 25 462 A1 discloses a road finishing machine with a layer thickness measuring means for determining a layer thickness of the produced paving layer in a region of a screed's rear edge. To determine the installed layer thickness at the screed's rear edge, a height signal of a sensor which is stationarily arranged at a combination of screed and pulling arm and detects a distance to the subsoil, and an inclination signal of an inclination sensor arranged at the screed-pulling arm combination are employed.

DE 11 2009 001 767 T5 discloses a road finishing machine having a control system for levelling the screed. The control system has a first sensor arranged at the front side of the road finishing machine in front of the material bunker to detect a height with respect to the subsoil. Furthermore, the control system comprises a second sensor which detects the height of the front pulling point at the screed arm with respect to the subsoil.

SUMMARY

An object underlying the disclosure is to equip a road finishing machine with a levelling system which reliably permits, by simple technical means qualified for practice, an improved levelling of the screed of the road finishing machine and which is above all suited for producing a more precise evenness of the installed paving layer. It is furthermore the object of the disclosure to provide a levelling method for a screed of a road finishing machine by means of which an even paving layer can be better produced.

This object is achieved by a road finishing machine according to the disclosure. Furthermore, this object is achieved by a method according to the disclosure.

Advantageous developments of the disclosure are given in the respective subclaims.

The road finishing machine according to the disclosure comprises a screed for producing a paving layer on a subsoil on which the road finishing machine is moving along a laying section in the laying direction. The screed is mounted to be height adjustable and has a pulling arm which is fixed to the road finishing machine at a front pulling point embodied thereon by means of a levelling cylinder. Moreover, the road finishing machine according to the disclosure comprises a measuring means for performing distance measurement, a storage means, a controlling system, and a closed-loop controller means operatively linked thereto to adapt a setting of the levelling cylinder.

In accordance with the disclosure, the control unit is embodied to calculate a correction value in response to at least one distance measurement of the measuring means with respect to the subsoil and/or to a reference which can be performed at a measuring point situated in front of the front edge of the screed in the laying direction. The correction value preferably reproduces an irregularity detected at the measuring point as a difference between a foundation and the actual subsoil with irregularities. Furthermore, the control unit is embodied to at least temporarily store the correction value in the storage means and to calculate a desired levelling value for the measuring point while the laying operation is continued taking into consideration the stored correction value, the levelling cylinder of the screed being controlled by means of said desired levelling value when the front edge of the screed reaches the measuring point.

Thereby, the closed-loop controller means purposefully reacts to an irregularity of the subsoil detected at the measuring point at a later point in time of the laying drive, namely at the time when the front edge of the towed screed reaches the measuring point where the irregularity in the subsoil was detected directly by means of the correction value. The determination of the correction value preceding the actual closed-loop controlling operation for detecting irregularities of the subsoil is based on a simple height measuring technique that can be perfectly employed at the road finishing machine. Furthermore, the disclosure offers the advantage that inclination sensors can be eliminated whereby the levelling system according to the disclosure has an altogether more robust design for construction site use. Moreover, the measuring means arranged in front of the screed in the disclosure is less influenced by the vibrating operation of the screed, so that the distances measured by means of the measuring means can be more precisely considered in the levelling of the screed. Furthermore, the disclosure offers an inexpensive solution which can be altogether attached and retrofitted to the road finishing machine in an easy way. By the closed-loop controlling means reacting, in the disclosure, to the detected irregularity of the measuring point only when the front edge of the screed reaches the measuring point, reaction times of the levelling cylinder can be better compensated, whereby a paving layer with high evenness can be produced.

Preferably, the measuring means is fixed to the pulling arm of the screed. Movements of the pulling arm, in particular a lifting and lowering of the pulling arm, can thereby be considered in the distance measurements. Above all, the measuring means can precisely detect, from the pulling arm laterally of the road finishing machine, i.e., directly next to the running gear, irregularities of the subsoil in front of the working area of the screed and/or measure a distance to a reference provided along the subsoil laterally of the screed which is present, for example, as a guiding wire tightened next to the road finishing machine. As a reference, a tightened rope, a curb, and/or an already produced paving layer would be possible as an alternative to the guiding wire.

According to a variant, the measuring means can be fixed to a tractor of the road finishing machine, wherein its measured values can be optionally calculated with measured values of a further measuring means which is arranged at the pulling arm or at the screed to adjust a certain screed height.

In a particularly advantageous variant, the measuring means is arranged in the region of the front pulling point of the pulling arm. Thereby, a distance measurement to the subsoil and/or to the reference can be performed directly at the site of the levelling cylinder, i.e., without any considerable influence of the pulling arm inclination, based on which a precise levelling of the screed is possible.

Preferably, the measuring means is rotatably fixed to the pulling arm, in particular at the front pulling point of the pulling arm or at least directly proximate thereto. It is thereby achieved that it maintains an equilibrium independent of an inclination change of the pulling arm controlled during the levelling process, or at least automatically moves back thereto. In other words, this means that the measuring means does not follow the inclination changes of the pulling arm. Thereby, the height measurements of the measuring means are not influenced by inclination changes of the pulling arm but only detect distance changes to the subsoil and/or to the reference.

In one variant, a linear guidance is formed at the pulling arm for the measuring means along which the measuring means is positionable to be adjustable in the laying direction. Thereby, the distance between the measuring means and the front edge of the screed can be adjusted. The measuring means can be rotatably mounted at the linear guidance to ignore inclination changes of the pulling arm.

According to one embodiment of the disclosure, the measuring means has at least one first sensor for measuring a distance to the reference, and at least one second sensor for measuring a distance to the subsoil. These two height measurements can be taken into consideration in the calculation of the correction value to thus detect irregularities of the subsoil. In one variant, the measuring means has a sensor which is embodied to detect both a distance to the subsoil and a distance to the reference. To this end, a radar sensor may be employed, for example.

Preferably, the first and the second sensors have the same distance to the front edge of the screed in the laying direction. Thereby, the two sensors can perform height measurements at the same measuring point in the laying direction, based on which an irregularity optionally present at the measuring point can be precisely detected as a deviation from the foundation. In this variant, two distance measurements are therefore performed at the same point in front of the screed, one with respect to the subsoil and the other one to the reference, to determine the correction value for this measuring point based thereon.

The first and/or the second sensors are preferably present in the form of an optical or acoustic sensor, e.g., as a laser or ultrasonic sensor. The height measurements can be performed by means of a runtime measurement, a phase position measurement, and/or laser triangulation.

It is conceivable that the determined correction value is visualizable as a measure for an irregularity detected in the subsoil compared to an averaged subsoil course (foundation) at the road finishing machine, for example by means of a display of the screed control platform. At the display, the correction factor can represent slight and comparatively large irregularities in different colors.

It is advantageous for the controlling system to be embodied to determine the correction value for the measuring point by means of the distance to the subsoil measured at the measuring point by means of the second sensor, minus the distance to the reference measured by means of the first sensor, and furthermore minus a pre-set altitude of the reference with respect to the foundation. A correction value calculated with this equation for the measuring point by means of the controlling system precisely reproduces the irregularity deviating from the foundation there, i.e., an elevation or an indentation in the subsoil.

Preferably, the controlling system is configured to form a difference of a pre-set desired basic levelling value and the stored correction value in an intermediate step to derive the desired levelling value for the measuring point, i.e., to form the desired value for a distance of the sensor to the reference. The desired basic levelling value offers a guidance value for the open-loop and closed-loop control function on the basis of which the screed should be towed assuming an even, averaged subsoil, i.e., a fictitious subsoil without irregularities. The correction value serves to adapt the desired basic levelling value for the practical case that the measuring means detects an irregularity in the subsoil, whereby a more precise desired levelling value adapted to the irregularity can be calculated for the measuring point. Thereby, the detected irregularity may be optimally compensated.

In an advantageous development, the controlling system is configured to calculate the desired levelling value from the difference between the pre-set desired basic levelling value and the stored correction value, minus a distance to the reference currently measured by means of the measuring means. This desired levelling value is then present at the closed-loop controller means as an input quantity based on which the levelling cylinder can be controlled for levelling the screed.

According to one embodiment, the measuring means has a plurality of sensors to measure a distance to the subsoil and/or to the reference, wherein the controlling system is embodied to form, based on a plurality of simultaneously performed distance measurements to the subsoil and/or to the reference, a respective average value as a basis to determine the correction value. By a plurality of distance measurements to the subsoil and/or to the reference being averaged to determine the correction value, a filter function is created so that smoother transitions are possible in the levelling of the screed because the closed-loop controller means thereby responds to irregularities during the laying operation quasi in a dampened manner.

In a development of the disclosure, the controlling system is configured to multiply the calculated correction value with a compensation factor depending on a geometry of the screed. It is conceivable that in the compensation factor, except for or instead of the geometry of the screed, for example, the weight of the screed and/or at least an operating parameter set and/or detected there during the operation of the screed, for example, a tamper speed and/or a heating power of the screed, are taken into consideration. It is furthermore conceivable that by means of the compensation factor, a density of the subsoil on which the road finishing machine is moving during the installation is taken into consideration. Thereby, a suppleness of the subsoil by which irregularities can optionally already be compensated by the operation of the screed can be taken into consideration during the levelling of the screed. In one embodiment, a laying temperature of the produced paving layer currently measured behind the screed is taken into consideration in the compensation factor.

Preferably, the road finishing machine has at least one path measuring means for detecting a covered distance of the front edge of the screed, wherein the calculation of the desired levelling value can be triggered at the controlling system if the covered distance of the screed detected by means of the path measuring means corresponds to a distance between the measuring means and the front edge of the screed. It is thus possible that the closed-loop controller means performs, at the right point in time and at the right place, i.e., at the measuring point, a locally precise levelling of the screed on the basis of the correction value calculated there, so that the irregularity optionally measured at the measuring point can be reliably compensated.

It is particularly advantageous for the controlling system to be embodied to continuously calculate correction values during a laying drive of the road finishing machine along the laying section, to store them for the respective measuring points, and to employ the respective stored correction values to determine adapted desired levelling values. It is achieved thereby that the closed-loop controller means reliably responds to all irregularities of the subsoil along the laying section, so that along the total laying section, an even paving layer may be produced.

Preferably, the controlling system is embodied to employ a GPS data-based subsoil data model to determine the correction value. In a variant, the GPS data-based subsoil data model can be stored by means of a web-based application, in particular by means of a cloud-based application, of the controlling system to supply the road finishing machine, in particular the controlling system embodied thereon, with updated geo-subsoil basic data along the laying section.

According to one embodiment of the disclosure, the controlling system is embodied to calculate the correction value taking into consideration a piston position of the levelling cylinder currently set at the measuring point. The piston position may be represented, for example, by means of an extension path of the piston, in particular detectable by the measuring means. It would thus be possible to determine an irregularity of the subsoil even if the measuring means only performs the distance measurement to the reference or to a tightened guiding wire, where otherwise, no distance measurement to the subsoil occurs. The detection of the piston position of the levelling cylinder can thereby replace the distance measurement to the subsoil. In certain types of subsoils, this can be advantageous in particular with open-pore subsoil surfaces.

It is conceivable that the controlling system is embodied to determine the correction value for the measuring point by means of the distance to the reference measured at the measuring point by means of the first sensor, plus the altitude of the reference to the foundation, plus a distance of the measuring means to the pulling point height, furthermore plus an extension path of the levelling cylinder set due to the piston position, and minus a constructive height between a bottom side of the running gear of the road finishing machine at the pulling point of the levelling cylinder in a retracted state.

The present disclosure also relates to a method for levelling a screed of a road finishing machine, wherein a controlling system of the road finishing machine calculates a correction value in response to at least one distance measurement performed with respect to the subsoil and/or to a reference by means of a measuring means provided at the road finishing machine, wherein the distance measurement is performed at a measuring point located in front of a front edge of the screed in the laying direction, at least temporarily stores said correction value in a storage means, and calculates a desired levelling value for the measuring point while the laying operation is continued taking into consideration the stored correction value, where by means of the desired levelling value, at least one levelling cylinder of the screed is controlled when the front edge of the screed reaches the measuring point.

Preferably, the measuring means performs at least two distance measurements at the measuring point in front of the screed to determine the correction value, namely one to the reference and one to the subsoil. Thereby, an irregularity of the subsoil optionally present at the measuring point can be determined locally precisely as a deviation from the foundation and be precisely employed for levelling the screed.

The levelling system according to the disclosure and the levelling method according to the disclosure can be performed at both sides of the road finishing machine. The embodiments presented above in connection with the disclosure can therefore be employed on both sides of the road finishing machine.

BRIEF DESCRIPTION OF THE DRAWINGS

Embodiments of the disclosure will be illustrated more in detail with reference to the following figures. In the drawings.

Figure 1:
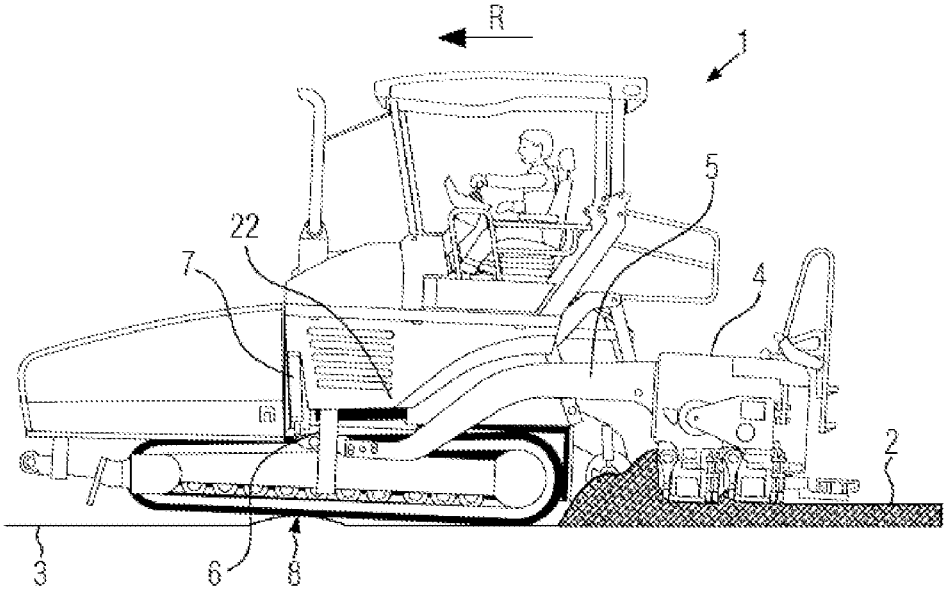
FIG. 1 shows a road finishing machine for producing a paving layer on a subsoil.

Equal components are always provided with equal reference numerals in the figures.

DETAILED DESCRIPTION

FIG. 1 shows a road finishing machine 1 that produces a paving layer 2 on a subsoil 3 on which the road finishing machine 1 is moving along a laying direction R during a laying drive. The road finishing machine 1 has a height-adjustable screed 4 for (pre-) compacting the paving layer 2. The screed 4 is fixed to a pulling arm 5 which is connected, at a front pulling point 6, with a levelling cylinder 7 at a tractor 22 of the road finishing machine 1. The pulling arm 5 serves as a lever to convert a variation of a levelling cylinder position into a corresponding change of an angle of attack of the screed 4, in particular to compensate irregularities 8 in the subsoil 3.

Figure 2:
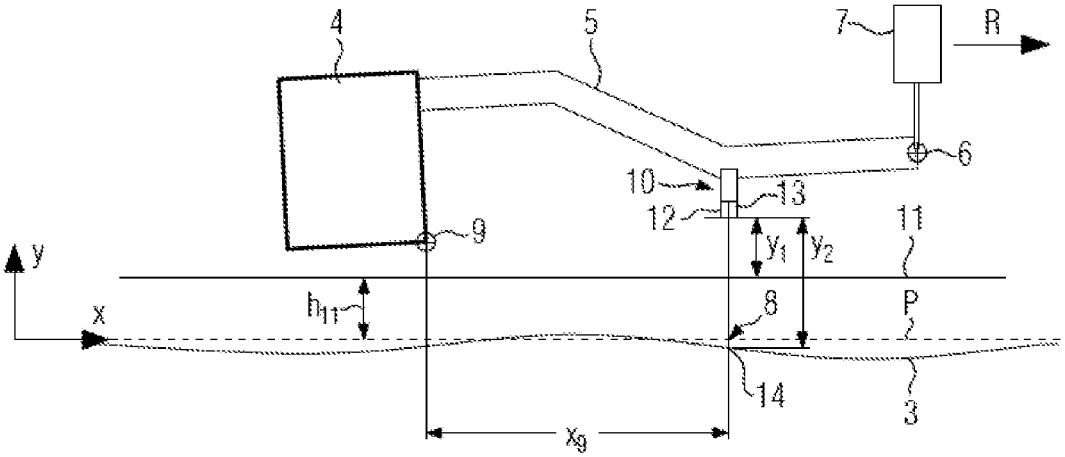
FIG. 2 shows a schematic isolated representation of the screed of the road finishing machine with a measuring means according to a variant of the disclosure.

FIG. 2 shows, in an isolated schematic representation, the screed 4, the pulling arm 5, and the levelling cylinder 7. A measuring means 10 is arranged at the pulling arm 5 between a front edge 9 of the screed and the front pulling point 6. The measuring means 10 is embodied to perform at least one distance measurement to the subsoil 3 and/or to a reference 11. According to FIG. 2, the reference 11 is built as a guiding wire, the reference 11 taking an averaged height $h_{11}$ above the subsoil 3. The reference 11 is tightened laterally of the road finishing machine 1 and provides a levelling function of the screed 4, as will be illustrated more in detail below.

In FIG. 2, the measuring means 10 has a first sensor 12 for measuring a distance $y_1$ to the reference, and a second sensor 13 for measuring a distance $y_2$ to the subsoil 3. Preferably, the first and the second sensors 12, 13 are positioned, in the laying direction R, at a same distance $x_9$ to the front edge 9 of the screed 4. Thus, at a measuring point 14 according to FIG. 2, two distance measurements are performed, one to measure the distance $y_1$, and one to measure the distance $y_2$.

FIG. 2 furthermore shows that the measuring means 10 can detect, by means of the two sensors 12, 13, an irregularity 8 in the subsoil 3 at the measuring point 14 underneath the measuring means 10. The irregularity 8 represents a difference to the foundation P. To compensate the irregularity 8 of FIG. 2, a corresponding levelling of the screed 4 takes place when, in a continued laying operation in the laying direction R, the front edge 9 of the screed 4 arrives above the irregularity 8, i.e., at the measuring point 14. In other words, the levelling system according to the variant shown in FIG. 2 employed according to the disclosure responds to the irregularity 8 detected by means of the measuring means 10 at the measuring point 14 when the front edge 9 of the screed 4 has passed the distance $x_9$ shown in FIG. 2.

Figure 3:
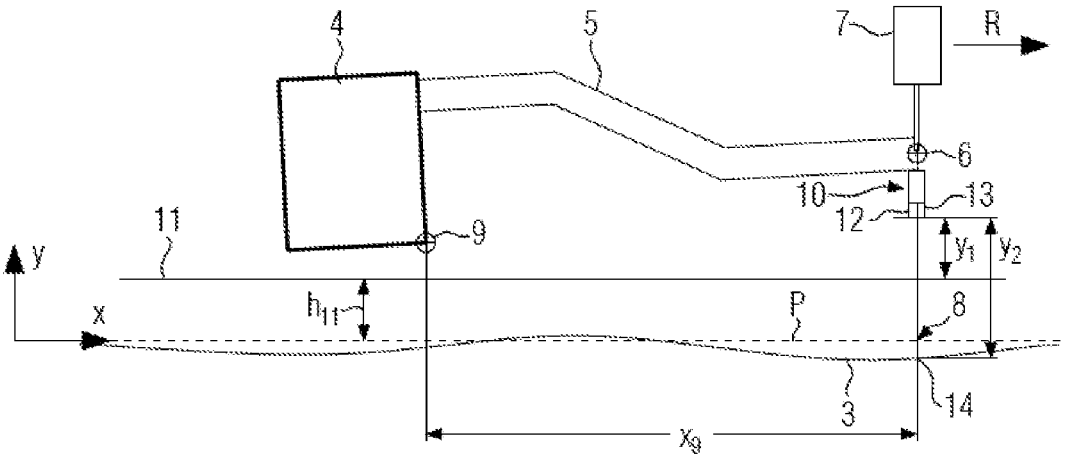
FIG. 3 shows a schematic isolated representation of the screed with a measuring means fixed thereto according to another variant of the disclosure.

FIG. 3 shows a variant for attaching the measuring means 10 of FIG. 2. The arrangement in FIG. 3 differs from FIG. 2 in that the measuring means 10 is directly positioned at the front pulling point 6. At this position, quasi at the front end of the pulling arm 5, the distances $y_1$, $y_2$ detected by means of the two sensors 12, 13, can particularly advantageously be employed to compensate irregularities 8 in the levelling of the screed 4 to produce an even paving layer 2 because at that point, the height of the pulling point 6 is exactly detected and not superimposed by the levelling changes of the screed 4.

Figure 4:
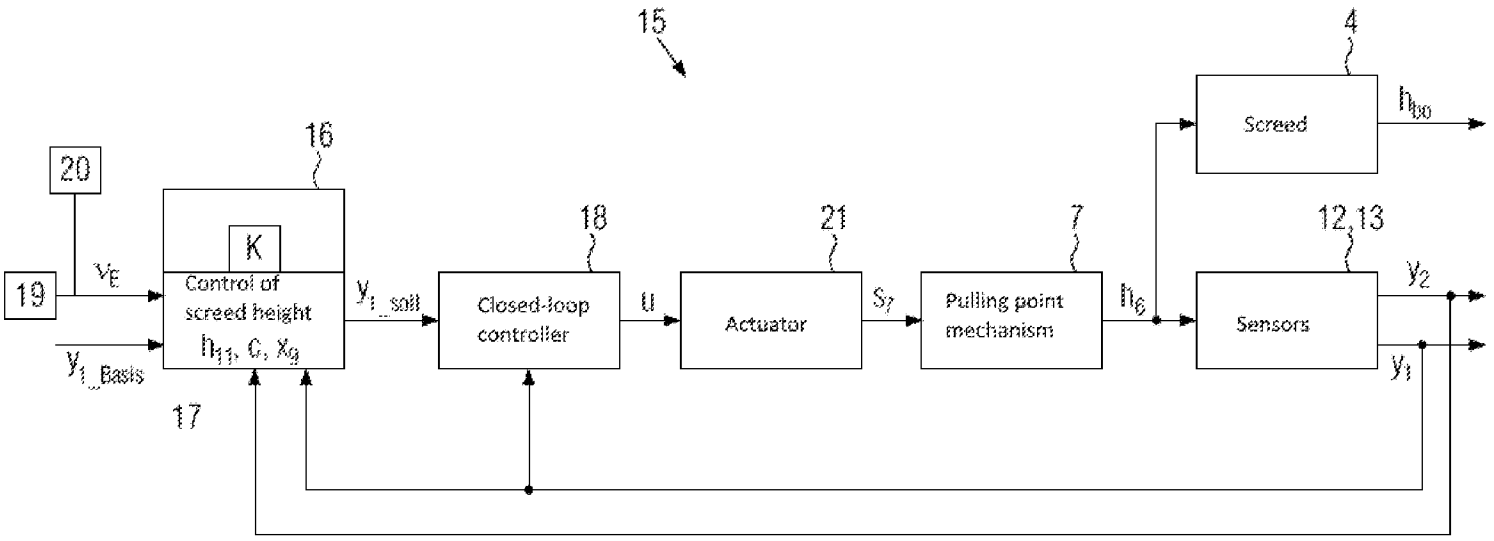
FIG. 4 shows a schematic representation of a control loop according to the disclosure for performing the levelling of the screed of FIGS. 2 and 3.

FIG. 4 shows a levelling system 15 in a schematic representation. The levelling system 15 can employ the measured height values detected according to FIG. 2 and FIG. 3 to level the screed 4 to compensate irregularities 8 in the subsoil 3.

The levelling system 15 has a storage means 16, a controlling system 17, and a closed-loop controller means 18 operatively linked thereto for adapting a setting of the levelling cylinder 7. According to FIG. 4, the measured distances $y_1$, $y_2$ of the sensors 12, 13 are forwarded to the controlling system 17. Based on the measured distances $y_1$, $y_2$ and taking into consideration the set height $h_{11}$ of the reference 11 above the foundation P, the controlling system 17 can determine a correction value K.

The controlling system 17 of FIG. 4 is embodied to determine the correction value K for the measuring point 14 by means of the distance $y_2$ to the subsoil 3 measured at the measuring point 14 by means of the second sensor 13, minus the distance $y_1$ to the reference 11 measured by means of the first sensor 12, and furthermore minus the pre-set height $h_{11}$ of the reference 11. Furthermore, the controlling system 17 can be configured to continuously store the correction values K determined during the laying operation along the laying section in the laying drive direction R for the respective measuring points 14 in the storage means 16, so that the correction values K can each be employed when the front edge 9 of the screed 4 reaches the corresponding measuring points 14 along the laying section for the levelling of the screed 4.

FIG. 4 furthermore shows that a current laying speed $V_E$ of the road finishing machine 1 can be displayed to the controlling system 17 by means of a speed sensor 19. The laying speed $V_E$ transmitted to the controlling system 17 may be employed to determine the distance $x_9$. According to FIG. 4, a path measuring means 20, such as a sensor, for the levelling system 15 can be provided, coupled thereto or as a functionally independent unit, to detect the distance $x_9$ or a covered section of the front edge 9 of the screed 4 if the road finishing machine 1 is moving forward in the laying direction R during the laying drive.

FIG. 4 furthermore shows that a pre-set desired basic levelling value $y_{1\text{-}Basis}$ is forwarded to the controlling system 17. Furthermore, a compensation factor c can be stored in the controlling system 17 which possibly depends on a geometry of the screed 4.

The controlling system 17 of FIG. 4 is configured to determine, for each stored correction value K, the covered path, i.e., the covered section, which the screed 4, in particular the front edge 9 embodied thereon, has passed since the time of the storing. As soon as the covered section corresponds to the distance $x_9$, the correction value K is subtracted from the desired basic levelling value $y_{1\text{-}Basis}$ by means of the controlling system 17. Optionally, the correction value K can previously be multiplied with the compensation factor c.

The desired basic levelling value $y_{1\text{-}Basis}$ can be manually set by an operator at a control panel of the road finishing machine, so that a desired height of the screed 4 can be accordingly adjusted for the laying operation. The height of the screed 4 can be manually determined by the operator or be measured by a non-depicted layer thickness sensor.

FIG. 4 furthermore shows that the desired levelling value $y_{1\text{-}Soll}$ determined for the measuring point 14 by means of the controlling system 17 taking into consideration the correction value K is forwarded to the closed-loop controller means 18. Furthermore, the measured distance $y_1$ is forwarded to the closed-loop controller means 18. The closed-loop controller means 18 is embodied to calculate, by means of a difference between the desired levelling values $y_{1\text{-}Soll}$ calculated based on irregularities 8 and the distance $y_1$ currently measured at the measuring point 14, a controller quantity u which is forwarded to an actuator 21. The actuator 21, for example a hydraulic drive component, thereupon determines an extension path $s_7$ of the levelling cylinder 7, so that a pulling point height $h_6$ can be adjusted to position the screed 4, in particular its screed's rear edge, at a desired height $h_{bo}$.

Figure 5:
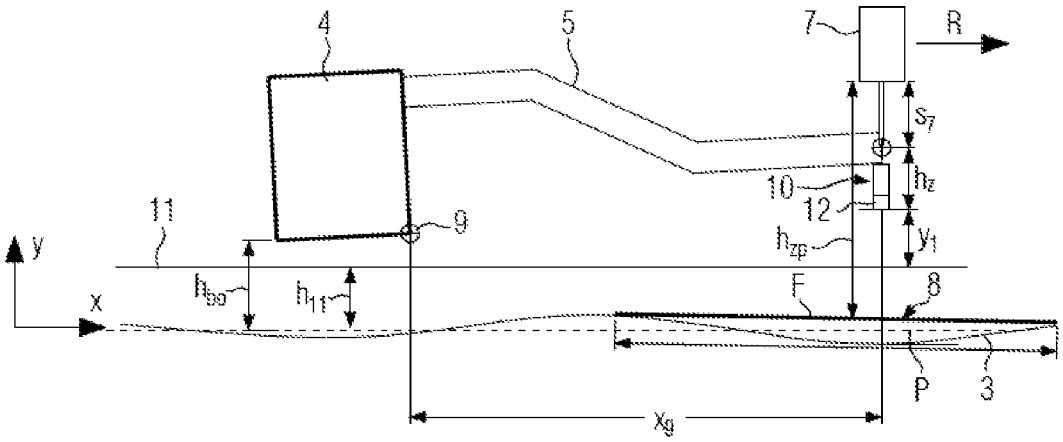
FIG. 5 shows a schematic isolated representation of the screed with a measuring means fixed thereto according to a further variant of the disclosure.

FIG. 5 essentially shows the arrangement of FIG. 3, wherein the measuring means 10 according to FIG. 5 only includes the first sensor 12 for measuring the distance $y_1$ to the reference 11. By means of the arrangement of FIG. 5, the correction value K can be calculated primarily by means of the distance $y_1$ and by means of the extension path $s_7$ of the levelling cylinder 7. For an irregularity 8 detected by means of the measuring means 10, the correction value K can be calculated from a sum of the distance $y_1$, the height $h_{11}$ to the reference 11, a distance $h_z$ of the first sensor 12 to the front pulling point 6, and the extension path $s_7$ of the levelling cylinder 7, minus a height $h_{zp}$, whereby a constructive height of a bottom side F of the running gear to the front pulling point 6 is given with the levelling cylinder 7 being retracted.

Figure 6:
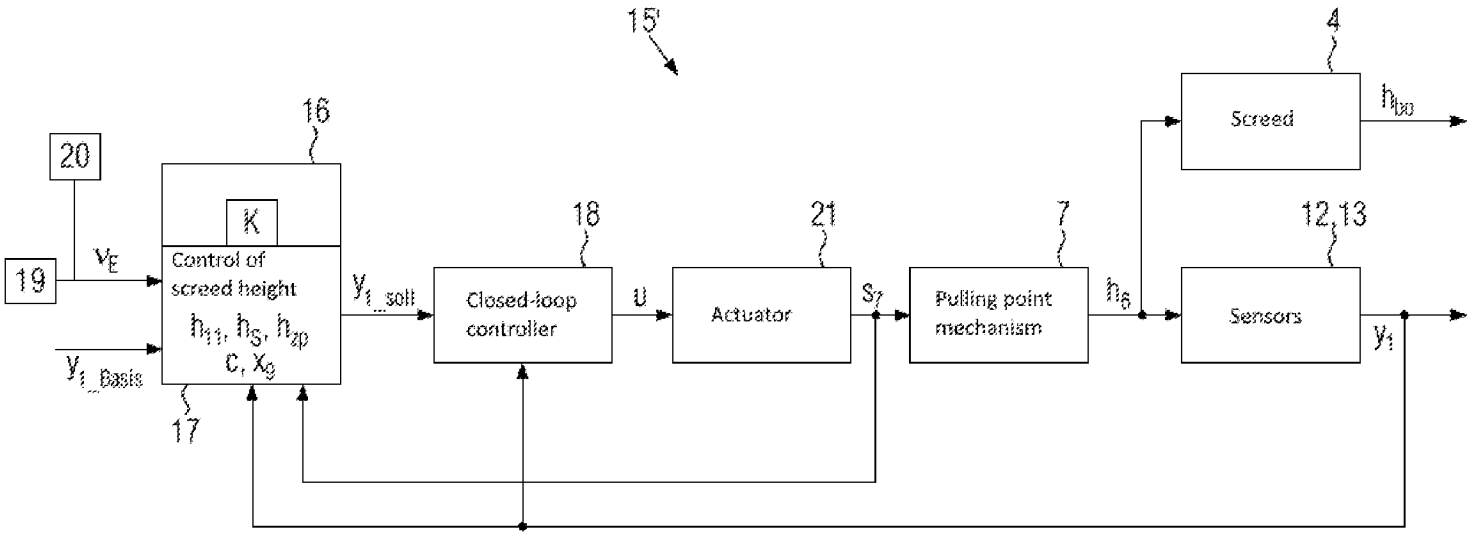
FIG. 6 shows a schematic representation of a control loop for levelling the screed according to the variant of FIG. 5.

FIG. 6 shows a levelling system 15' for the arrangement shown in FIG. 5 in a schematic representation. Here, the measured distances $y_1$ and the detected extension paths $s_7$ of the levelling cylinder 7 are continuously forwarded to the controlling system 17, based on which the correction value K is calculated and stored in the storage means 16 for each measuring point 14 along the laying section. The correction value K can be calculated by means of the above-described sum, minus the height $h_{zp}$ present when the levelling cylinder 7 is retracted. The desired basic levelling value $y_{1\text{-}Soll}$ stored for the controlling system 17 is calculated to the desired levelling value $y_{1\text{-}Soll}$, minus the correction value K, which is forwarded to the closed-loop controller means 18 as an input quantity at the latest when the front edge 9 of the screed 4 has arrived at the measuring point 14 for the measured distance $y_1$, wherein the closed-loop controller means 18 determines, from a difference of the calculated desired levelling value $y_{1\text{-}Soll}$ and the measured distance $y_1$, the controller quantity u for the actuator 21 which accordingly adjusts the levelling cylinder 7 to level the screed 4.

As one skilled in the art would understand, the controlling system 17 and controller means 18 (e.g., controller) may individually or collectively include suitable hardware and software, such as one or more processors (e.g., one or more microprocessors, microcontrollers and/or programmable digital signal processors) in communication with, or configured to communicate with, one or more storage devices or media (such as the storage means 16, which may comprise a magnetic storage device, an optical storage device, a solid-state storage device, and/or any other suitable storage device) including computer readable program instructions that are executable by the one or more processors so that the controlling system 17 and/or controller means 18 may perform particular algorithms represented by the functions and/or operations described herein. The controlling system 17 and/or controller means 18 may also, or instead, include one or more application specific integrated circuits, programmable gate arrays or programmable array logic, programmable logic devices, or digital signal processors.

What is claimed is:

1. A road finishing machine, comprising a screed for producing a paving layer on a subsoil on which the road finishing machine is movable in a laying direction along a laying section, wherein the screed is height-adjustable and has a pulling arm which is fixed to the road finishing machine at a front pulling point formed thereon by means of a levelling cylinder, at least one measuring means for performing at least one distance measurement, a storage means, a controlling system and a closed-loop controller means operatively linked thereto for adapting a setting of the levelling cylinder, wherein the controlling system is embodied to calculate a correction value in response to at least one distance measurement performed with respect to the subsoil and/or to a reference, which is performable at a measuring point located in front of a front edge of the screed in the laying direction, to at least temporarily store the correction value in the storage means and calculate, with a continued laying operation, a desired levelling value for the measuring point, taking into consideration the stored correction value, and wherein the levelling cylinder of the screed is controllable based on the desired levelling value when the front edge of the screed reaches the measuring point.

2. The road finishing machine according to claim 1, wherein the at least one measuring means is fixed at the pulling arm of the screed.

3. The road finishing machine according to claim 1, wherein the at least one measuring means is arranged in a region of the front pulling point of the pulling arm.

4. The road finishing machine according to claim 1, wherein the at least one measuring means comprises a first sensor for measuring a distance to the reference and a second sensor for measuring a distance to the subsoil.

5. The road finishing machine according to claim 4, wherein the first sensor and the second sensor have a same distance to the front edge of the screed in the laying direction.

6. The road finishing machine according to claim 4, wherein the controlling system is embodied to determine the correction value for the measuring point by means of the distance to the subsoil measured at the measuring point by means of the second sensor, minus the distance to the reference measured by means of the first sensor, and furthermore minus a pre-set altitude of the reference to the subsoil.

7. The road finishing machine according to claim 4, wherein the controlling system is configured to form, in an intermediate step, a difference of a pre-set desired basic levelling value and the stored correction value to derive the desired levelling value for the measuring point.

8. The road finishing machine according to claim 7, wherein the controlling system is configured to calculate, from the difference between the pre-set desired basic levelling value and the stored correction value, minus a distance to the reference currently measured by means of the at least one measuring means, the desired levelling value.

9. The road finishing machine according to claim 1, wherein the at least one measuring means comprises a plurality of sensors for measuring a distance to the subsoil and/or to the reference, wherein the controlling system is embodied to form, based on a plurality of distance measurements to the subsoil and/or to the reference performed simultaneously, a respective average value as a basis for the determination of the correction value.

10. The road finishing machine according to claim 1, wherein the controlling system is configured to multiply the calculated correction value with a compensation factor depending on a geometry of the screed.

11. The road finishing machine according to claim 1, wherein the road finishing machine includes, for detecting a covered section of the front edge of the screed, at least one path measuring means, wherein the calculation of the desired levelling value can be triggered by means of the controlling system, if the covered section of the front edge of the screed detected by the at least one path measuring means corresponds to a distance between the at least one measuring means and the front edge of the screed.

12. The road finishing machine according to claim 1, wherein the controlling system is embodied to continuously calculate correction values during a laying drive of the road finishing machine along the laying section, to store them and to employ the respective stored correction values to determine adapted desired levelling values.

13. The road finishing machine according to claim 1, wherein the controlling system is embodied to employ a GPS data-based subsoil data model to determine the correction value.

14. The road finishing machine according to claim 1, wherein the controlling system is embodied to calculate the correction value taking into consideration a piston position of the levelling cylinder currently set at the measuring point.

15. The road finishing machine according to claim 1, wherein the at least one measuring means is fixed to a tractor of the road finishing machine, wherein its measured values can be calculated with measured values of a further measuring means which is arranged at the pulling arm or at the screed to control a certain screed height.

16. A method for levelling a screed of a road finishing machine, the method comprising:

calculating, using a controlling system of the road finishing machine, a correction value in response to at least one distance measurement of a measuring means performed with respect to a subsoil and/or to a reference, wherein the at least one distance measurement is performed at a measuring point located in front of a front edge of the screed in a laying direction;

at least temporarily storing the correction value;

calculating a desired levelling value for the measuring point with a continued laying operation, taking into consideration the stored correction value; and controlling at least one levelling cylinder of the screed, based on the desired levelling value, when the front edge of the screed reaches the measuring point.

17. A road finishing machine, comprising:

a screed for producing a paving layer on a subsoil on which the road finishing machine is movable in a laying direction, wherein the screed is height-adjustable and has a pulling arm;

a leveling cylinder that connects the pulling arm to a portion of the road finishing machine;

at least one measuring sensor for performing at least one distance measurement, with respect to the subsoil and/or to a reference, at a measuring point located in front of a front edge of the screed in the laying direction; and a controlling system that is embodied to calculate a correction value based on the at least one distance measurement, at least temporarily store the correction value in a storage means and calculate a desired levelling value for the measuring point, taking into consideration the stored correction value, and wherein the levelling cylinder of the screed is controllable based on the desired levelling value when the front edge of the screed reaches the measuring point.

* * * * *